US011085300B1

(12) United States Patent
Grisar et al.

(10) Patent No.: US 11,085,300 B1
(45) Date of Patent: Aug. 10, 2021

(54) PRIME MOVERS, PUMPS AND COMPRESSORS HAVING RECIPROCATING VANE ACTUATOR ASSEMBLIES AND METHODS

(71) Applicant: REGI U.S., INC., Spokane, WA (US)

(72) Inventors: Robert Grisar, Ruskin, FL (US); Allen MacKnight, Signal Hill, CA (US); Paul Porter, Colbert, WA (US)

(73) Assignee: Regi U.S., Inc., Spokane, WA (US)

( * ) Notice: Subject to any disclaimer, the term of this patent is extended or adjusted under 35 U.S.C. 154(b) by 305 days.

(21) Appl. No.: 15/946,147

(22) Filed: Apr. 5, 2018

Related U.S. Application Data

(60) Provisional application No. 62/556,240, filed on Sep. 8, 2017.

(51) Int. Cl.

| | |
|---|---|
| ***F01C 21/08*** | (2006.01) |
| ***F01C 19/08*** | (2006.01) |
| ***F01C 1/344*** | (2006.01) |
| ***F01C 1/24*** | (2006.01) |
| ***F01C 1/356*** | (2006.01) |
| ***F01C 1/348*** | (2006.01) |

(52) U.S. Cl.
CPC ..... *F01C 1/3448* (2013.01); *F01C 1/24* (2013.01); *F01C 1/348* (2013.01); *F01C 21/0836* (2013.01)

(58) Field of Classification Search
CPC ..... F01C 1/3568; F01C 1/3448; F01C 1/24; F01C 1/348; F01C 21/0836; F01C 19/08; F01C 21/0809
USPC ..... 418/219
See application file for complete search history.

(56) References Cited

U.S. PATENT DOCUMENTS

| | | | |
|---|---|---|---|
| 570,584 | A | 11/1896 | White |
| 1,527,685 | A | 2/1925 | Huwiler |
| 1,686,767 | A | 10/1928 | Saxon |
| 1,846,557 | A | 2/1932 | Imshenetsky |
| 2,345,561 | A | 4/1944 | Allen, Jr. |
| 2,590,729 | A | 3/1952 | Scognamillo |

(Continued)

FOREIGN PATENT DOCUMENTS

| | | |
|---|---|---|
| DE | 3515609 | 11/1985 |
| EP | 0130171 | 1/1985 |

(Continued)

OTHER PUBLICATIONS

GB163813 to Mundey, May 27, 1921.*

*Primary Examiner* — Deming Wan
(74) *Attorney, Agent, or Firm* — Lee & Hayes, P.C.

(57) ABSTRACT

Prime movers are provided that can include: a fixed member in operational relationship to a rotating member; a reciprocating vane assembly operationally engaged with the rotating member; and a track member about the rotating member and engaging the reciprocating vane assembly. Engines are provided that can include: a stator in operational relationship to a rotor; a reciprocating vane assembly operationally engaged with the rotor; and a track member about the rotor and engaging the reciprocating vane assembly. Processes for powering a prime mover are also provided, the processes can include engaging vanes between a fixed member and rotating member to create compression and expansion zones, the engaging comprising guiding the vanes from a track member about the rotating member.

20 Claims, 3 Drawing Sheets

(56) References Cited

U.S. PATENT DOCUMENTS

| | | | | |
|---|---|---|---|---|
| 3,164,139 | A | 1/1965 | Appleton | |
| 3,468,260 | A | 9/1969 | Belden | |
| 3,551,080 | A | 12/1970 | Feller | |
| 3,769,945 | A | 11/1973 | Kahre | |
| 3,780,709 | A | 12/1973 | Williams | |
| 3,799,710 | A | 3/1974 | Jacobs | |
| 3,819,309 | A | 6/1974 | Jacobs | |
| 3,865,521 | A | 2/1975 | Upchurch | |
| 3,873,253 | A | 3/1975 | Eickmann | |
| 3,886,910 | A * | 6/1975 | Vrooman | F01C 1/3448 418/219 |
| 3,942,484 | A | 3/1976 | Pile | |
| 4,004,556 | A | 1/1977 | Pfeiffer | |
| 4,028,028 | A | 6/1977 | Fuchs, Jr. | |
| 4,047,859 | A | 9/1977 | Sundberg | |
| 4,170,213 | A | 10/1979 | Williams | |
| 4,325,394 | A | 4/1982 | Reams | |
| 4,401,070 | A | 8/1983 | McCann | |
| 4,439,117 | A | 3/1984 | Bunger | |
| 4,474,105 | A | 10/1984 | Eicher et al. | |
| 4,492,541 | A | 1/1985 | Mallen-Herrero et al. | |
| 4,521,167 | A | 6/1985 | Cavalleri et al. | |
| 4,573,892 | A | 3/1986 | DuFrene | |
| 4,575,324 | A | 3/1986 | Sommer et al. | |
| 4,667,468 | A | 5/1987 | Hansen | |
| 4,799,867 | A | 1/1989 | Sakamaki et al. | |
| 5,429,084 | A * | 7/1995 | Cherry | F01C 1/3448 123/243 |
| 5,509,793 | A | 4/1996 | Cherry et al. | |
| 5,551,853 | A | 9/1996 | Cherry et al. | |
| 7,059,843 | B1 | 6/2006 | Badgley | |
| 7,896,630 | B2 | 3/2011 | Grisar et al. | |
| 8,347,848 | B2 * | 1/2013 | Sleiman | F01C 21/0809 123/243 |
| 2006/0008374 | A1 | 1/2006 | Robertson et al. | |
| 2010/0319653 | A1 * | 12/2010 | Zalewski | F01C 1/3448 123/213 |

FOREIGN PATENT DOCUMENTS

| | | | | |
|---|---|---|---|---|
| EP | 0333883 | | 9/1989 | |
| EP | 0548416 | | 6/1993 | |
| EP | 1617040 | | 1/2006 | |
| GB | 163813 | A * | 5/1921 | F02B 53/00 |
| GB | 1110162 | | 4/1968 | |
| GB | 1430196 | | 3/1976 | |
| GB | 1469583 | | 4/1977 | |
| GB | 2419382 | | 4/2006 | |
| JP | 55098689 | | 7/1980 | |
| JP | 0019637 | | 1/1990 | |
| JP | 02019601 | | 1/1990 | |
| WO | WO8503736 | | 8/1985 | |
| WO | WO9404793 | | 3/1994 | |
| WO | WO9404794 | | 3/1994 | |
| WO | WO0133082 | | 5/2001 | |
| WO | WO2006018848 | | 2/2006 | |

* cited by examiner

PRIME MOVERS, PUMPS AND COMPRESSORS HAVING RECIPROCATING VANE ACTUATOR ASSEMBLIES AND METHODS

CLAIM FOR PRIORITY

This application claims priority to U.S. Provisional Patent Application Ser. No. 62/556,240 filed Sep. 8, 2017, entitled "Prime Movers, Pumps and Compressors Having Reciprocating Vane Actuator Assemblies and Methods", the entirety of which is incorporated by reference herein.

TECHNICAL FIELD

The present invention relates to prime movers, pumps and compressors and in particular embodiments, engines, compressors or expanders having vane separated compression compartments.

BACKGROUND

Example rotary engines are described in U.S. Pat. No. 7,896,630. Assemblies of this disclosure provide vane separated compression and expansion compartments and, where vanes are reciprocated axially from cam surface to cam surface while propelled radially by the rotor.

The present disclosure provides reciprocating vane actuators.

SUMMARY

The present disclosure provides prime movers configured in some embodiments as engines, expanders or compressors that have reciprocating vane actuators.

The present disclosure provides a prime mover that can include a rotating member or rotor axially aligned with a stationary, fixed, or stator member within an outer member. The rotating member and stationary member can be aligned about a center axis that may be a rod, vanes can reciprocate and follow a curved cam surface of the outer member which compliments curved surfaces of the rotating and stationary members. The vanes can be attached to each other by a tube or similar device which is designed to follow the curved cam surface in tune with unique features found in the vane actuating mechanism which can focus the axial positioning of the vanes relative to those of the rotating and stationary members.

Controlling the vane movement between the rotating member and the stationary member has several benefits, including but not limited to, minimizing the forces acting on the member surfaces, damping acceleration and deceleration forces, reducing wear on critical vane components, allowing tip, side and vane seals to act without large forces acting upon them and reducing overall friction in the device.

Prime movers are provided that can include: a fixed member in operational relationship to a rotating member; a reciprocating vane assembly operationally engaged with the rotating member; and a track member about the rotating member and engaging the reciprocating vane assembly.

Engines are provided that can include: a stator in operational relationship to a rotor; a reciprocating vane assembly operationally engaged with the rotor; and a track member about the rotor and engaging the reciprocating vane assembly.

Processes for powering a prime mover are also provided; the processes can include engaging vanes between a fixed member and rotating member to create compression and expansion zones, the engaging comprising guiding the vanes from a track member about the rotating member.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 2:
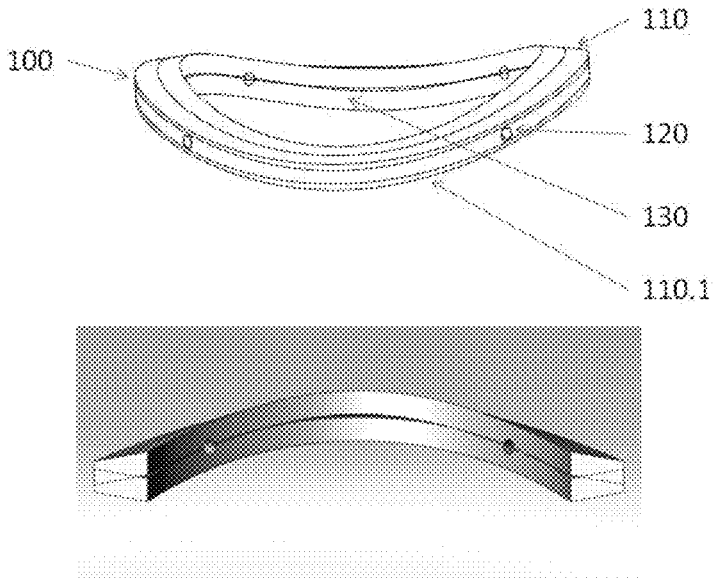
FIG. 2 is an isometric view showing a stator or rotor member of the reciprocating vane actuator of FIG. 1.
Figure 3:
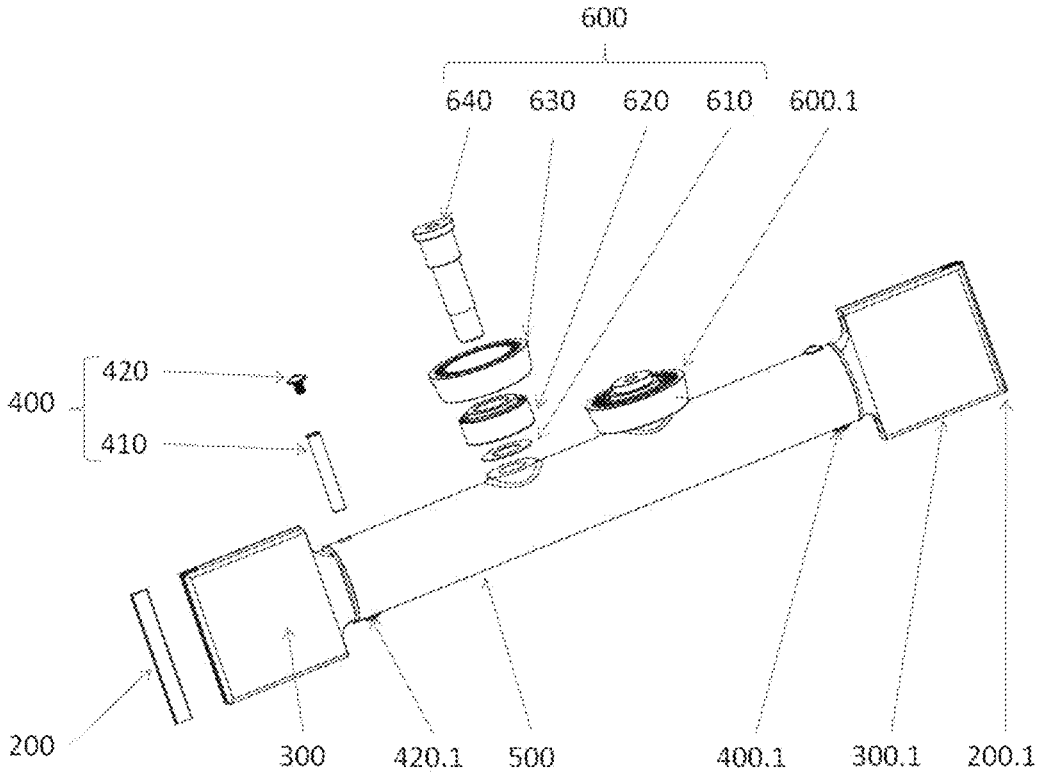
FIG. 3 is an isometric, partially exploded view showing the vane actuator of the reciprocating vane actuator of FIG. 1.

The present disclosure will be described with reference to FIGS. 1-3. The vane actuator assemblies of the present disclosure are for use with prime movers of the type described in U.S. Pat. No. 7,896,630, the entirety of which is incorporated by reference herein. The '630 reference includes vanes 130 operably engaging rotating members and stationary members. Each of these members has an undulated surface, such as surface 150. In the '630 reference the vanes are guided through force applied by these surfaces which leads to remarkably unworkable wear.

Figure 1:
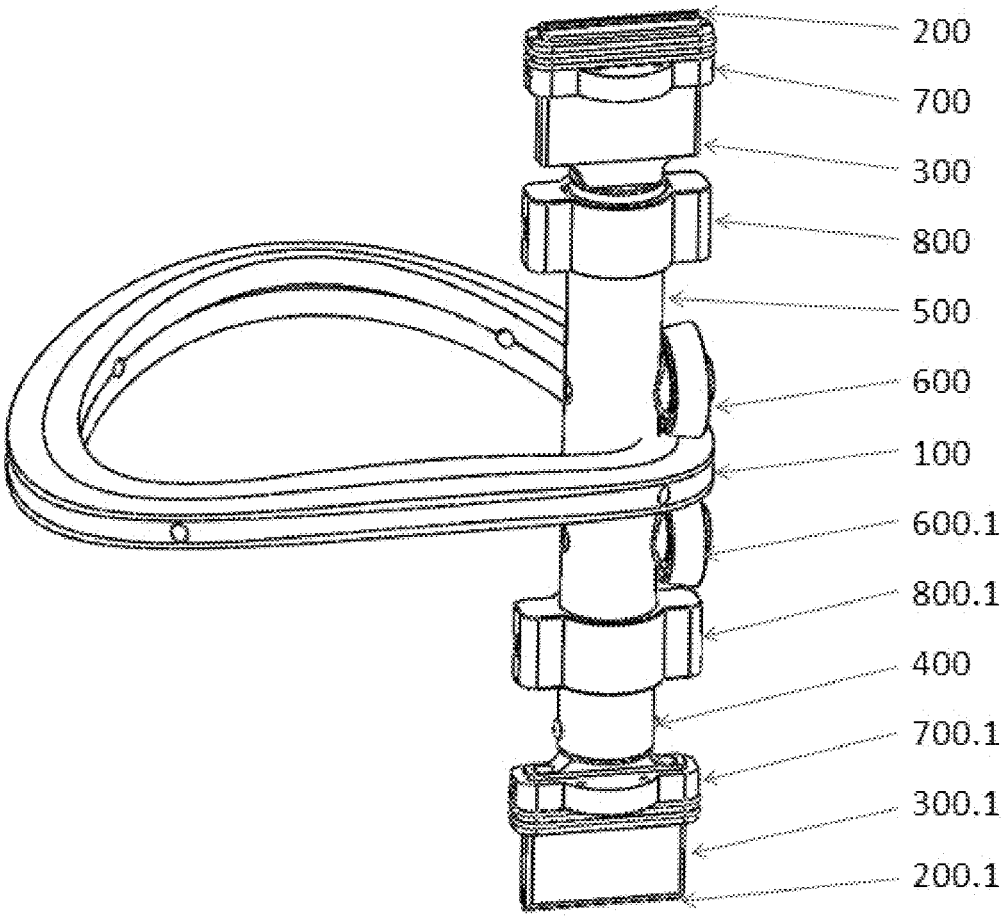
FIG. 1 is a simplified isometric view showing a reciprocating vane actuator according to the embodiment of the invention.

Reciprocating vane actuators of the present disclosure can include dual wheel bearings (FIG. 1, items 600 and 600.1) that are fastened to a connecting tube ((FIG. 1, item 500). The dual wheel bearings can react against a sinusoidal stator surface (FIG. 1, item 100) thereby moving the reciprocating vane actuator axially while the rotor propels the reciprocating vane actuator radially. In accordance with example implementations, the connecting tube may be inset within one of the members. In this example, the tubes are inset within the rotating member and the stator surface 100 resides about the rotating member but mirrors the undulating surface of the fixed or stationary member. Stator surface 100 can be coupled to or be a part of a housing that is fixed in relation to the stationary member.

The reciprocating vane actuator can include opposing vanes (FIGS. 1. 300 and 300.1) that are attached at opposite ends of a Connecting Tube (FIG. 1. 500).

Vane components of the reciprocating vane actuator (FIG. 1, items 300 and 300.1) can intersect slot openings in the rotor or stator. The tip of each vane includes provisions to hold apex seals and linear expander springs (FIG. 1, items 200 and 200.1) which dynamically engage the undulating surface of the member. In accordance with other example implementations, the vanes may be biased against the guidance of the wheels with coils, elastomeric, and/or gas operating structures.

The connecting tube can include two axles (FIG. 3. 640) and bearing-wheel (FIG. 3. 600) assemblies. The wheel assembly, which can include a commercial bearing (FIG. 3. 620) and a conical wheel (or tire) (FIG. 3. 630) may be fitted onto the axle (FIG. 3. 640). In this implementation, the wheels are designed to follow the rotor or stator cam (FIG. 2. 100) which operably coupled between the two wheel assemblies.

The wheels travel along the track of the sinusoidal surface of the stator or rotor. To minimize wheel wear and track slippage, the sinusoidal stator or rotor and the mating wheels each have matching conical surfaces, such that the travel distance for the inner and outer edges of the wheel are identical in length. Please refer to FIG. 2 for detail of the conical cross section of the stator surface.

In this implementation, as the wheels circumnavigate the stator or rotor, their axial position, follows the sinusoidal stator or rotor surface. As the surface increases towards maximum, the wheels move the attached connecting tube in the same direction, thusly moving the vanes in a precise manner providing positive control over the forces acting on the vanes and seals in the device.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A prime mover comprising:

a rotating member;

a reciprocating vane assembly operationally engaged with the rotating member, the reciprocating vane assembly including one or more wheels, wherein the reciprocating vane assembly is configured to translate in an axial direction along a longitudinal axis of the prime mover as the rotating member rotates about the longitudinal axis; and a track member about the rotating member, wherein the one or more wheels of the reciprocating vane assembly engage the track member.

2. The prime mover of claim 1, wherein the reciprocating vane assembly comprises vane tips.

3. The prime mover of claim 2, further comprising sealing material engaging the vane tips.

4. The prime mover of claim 2, further comprising linear expander springs engaging the vane tips.

5. The prime mover of claim 1, wherein the reciprocating vane assembly comprises a connecting chamber housing opposing vanes attached at opposite ends.

6. The prime mover of claim 1, wherein the one or more wheels are spaced apart by a distance substantially equal to a thickness of the track member.

7. The prime mover of claim 1, wherein track member comprises a sinusoidal curvature.

8. An engine comprising:

a stator in operational relationship to a rotor a reciprocating vane assembly operationally engaged with the rotor, wherein the reciprocating vane assembly is configured to translate in an axial direction along a longitudinal axis of engine during rotation of the rotor about the longitudinal axis; and a track member about the rotor and engaging the reciprocating vane assembly, wherein the reciprocating vane assembly comprises one or more wheel bearings that engage the track member.

9. The engine of claim 8, wherein the reciprocating vane assembly comprises a chamber housing opposing vanes.

10. The engine of claim 9, wherein the one or more wheel bearings operationally couple to a vane through the chamber.

11. The engine of claim 9, wherein at least a portion of the chamber is disposed within an inner perimeter of the track member.

12. The engine of claim 8, wherein the one or more wheel bearings define a first surface engaging a second surface of the track member, wherein the first surface and the second surface are complimentary.

13. The engine of claim 8, wherein the one or more wheel bearings individually mount to an axle about a bearing.

14. The engine of claim 8, wherein the vanes include vane tips to engage the stator.

15. The engine of claim 8, wherein track member comprises a sinusoidal curvature.

16. A process for powering a prime mover, the process comprising engaging vanes and a rotating member to create compression and expansion zones, the engaging comprising guiding the vanes via one or more wheels along a track member about the rotating member, wherein the vanes translate in an axial direction along a longitudinal axis of the prime mover during rotation of the rotating member about the longitudinal axis.

17. The process of claim 14, wherein the vanes include vane tips.

18. The process of claim 14, wherein the one or more wheels comprise:

a first wheel engaging a first surface of the track member; and a second wheel engaging a second surface of the track member, the second surface being complimentary to the first surface.

19. The process of claim 14, wherein the vanes comprise a first vane and a second vane, the first vane and the second vane being coupled via a housing.

20. The process of claim 14, wherein the track member comprises a sinusoidal trajectory.

* * * * *